US005453663A

United States Patent [19]

Nakayama

[11] Patent Number: 5,453,663

[45] Date of Patent: Sep. 26, 1995

[54] LIGHTING APPARATUS WITH AUTO-RECHARGING

[75] Inventor: Tsuneo Nakayama, Yokohama, Japan

[73] Assignee: Kabushiki Kaisha Toshiba, Kanagawa, Japan

[21] Appl. No.: 148,255

[22] Filed: Nov. 5, 1993

[30] Foreign Application Priority Data

Nov. 6, 1992 [JP] Japan ..... 4-296919

[51] Int. Cl.[6] ..... H05B 41/36

[52] U.S. Cl. ..... 315/159; 315/154; 362/800

[58] Field of Search ..... 315/149, 150, 315/151, 152–153, 154–155, 158, 86, 87, 159; 250/205; 307/66; 257/149; 362/800

[56] References Cited

U.S. PATENT DOCUMENTS 4,686,425 8/1987 Havel ..... 315/152

*Primary Examiner*—Ali Neyzari

*Attorney, Agent, or Firm*—Finnegan, Henderson, Farabow, Garrett & Dunner

[57] ABSTRACT

A lighting apparatus has a secondary battery, at least two light emitters connected in parallel with each other, first switches, and second switches. When the first switches are each ON, i.e., closed and the second switches are each OFF, i.e., open, the light emitters are connected in parallel with each other and in series with the secondary battery. When the first switches are each OFF and the second switches are each ON, the light emitters and secondary battery are connected in series.

7 Claims, 5 Drawing Sheets

LIGHTING APPARATUS WITH AUTO-RECHARGING

BACKGROUND OF THE INVENTION

1. Field of the Invention

The present invention relates to a lighting apparatus employing light emitting diodes (hereinafter referred to as LEDs) as displaying or lighting elements, and particularly, to a lighting apparatus employing LEDs as displaying or lighting elements, installed at a remote or high place where maintenance is difficult.

The LEDs have photoelectric conversion characteristics. Making use of the characteristics, the present invention employs the LEDs as solar cells for a lighting apparatus. During the daytime when no lighting is required, the LEDs generate electricity, which is accumulated in a secondary battery of the lighting apparatus and is used as part of lighting power during the nighttime. This arrangement helps reduce the size of a power source of the lighting apparatus.

2. Description of the Prior Art

Lighting apparatuses employing LEDs as lighting elements are frequently installed at a remote or high place where maintenance is difficult. Power sources of the lighting apparatuses of this kind are converters for converting commercial power into direct current power, or solar cells.

A typical lighting apparatus with LEDs according to a prior art includes a power source, a lighting unit, and a switching circuit. The switching circuit is disposed between the power source and the lighting unit, to detect surrounding brightness. If the brightness is greater than a set level, the switching circuit turns the lighting unit off. The switching circuit may have a timer for turning the lighting unit on and off at predetermined intervals.

When the lighting apparatus employs commercial power as source energy and is installed at a remote place, it requires costly power distribution facilities and maintenance work.

When the lighting apparatus employs solar cells as a power source, it may require inexpensive distribution facilities and maintenance work. The lighting apparatus of this sort, however, needs a solar panel that is large compared with the size of a light emitting area. The solar panel requires separate support and maintenance facilities to increase cost. Although the solar panel is useless during the nighttime because it generates no power in the dark, it requires maintenance and support all the time.

In this way, the lighting apparatus with LEDs using commercial electricity must be equipped with a converter for converting the commercial electricity into direct currents. The lighting apparatus with LEDs using solar energy must have a large solar panel. Namely, the conventional lighting apparatuses with LEDs are bulky, involve costly structures, limit installation sites, and require strong foundations.

SUMMARY OF THE INVENTION

An object of the present invention is to provide a lighting apparatus with LEDs, having a compact power source. The lighting apparatus uses the LEDs as solar cells by utilizing their photoelectric conversion characteristics. During the daytime when no lighting is required, the LEDs generate electricity, which is stored in a secondary battery of the lighting apparatus and is used as part of lighting energy during the nighttime.

Another object of the present invention is to provide an inexpensive lighting apparatus with LEDs,having a compact power source, or no exclusive power source. During the daytime when no lighting is required, the LEDs, which originally serve as lighting and displaying elements, are used as solar cells to generate electricity. The electricity is stored in a secondary battery and is used as part of lighting power during the nighttime. During the nighttime, the LEDs are intermittently lit to shorten a lighting period and save power.

In order to accomplish the objects, a first aspect of the present invention provides a lighting apparatus shown in FIG. 1, having a secondary battery B, at least two LEDs LED1 and LED2 connected in parallel with each other, first switches Sa1 and Sa2, and a second switch Sb1.

When the first switches Sa1 and Sa2 are each ON, i.e., closed and the second switch Sb1 is OFF, i.e., open, the LEDs LED1 and LED2 are connected in parallel with each other and In series with the secondary battery B.

When the first switches Sa1 and Sa2 are each OFF and the second switch Sb1 is ON, the LEDs LED1 and LED2 and secondary battery B are connected in series.

The first switch Sa1 (Sa2) has a first normally ON field effect transistor FETa1 (FETa2) and a first photosensor LEDa1 (LEDa2) made of a LED connected to the gate and source of the transistor FETa1 (FETa2). The second switch Sb1 has a second normally ON field effect transistor FETb1 and a second photosensor LEDb1 made of a LED connected to the gate and source of the transistor FETb1.

According to the first aspect of the present invention, the first photosensor LEDa1 (LEDa2) of the first switch Sa1 (Sa2) achieves photovoltaic effect when it is light, to apply a reverse bias voltage to the gate and source of the first transistor FETa1 (FETa2), to thereby turn the transistor FETa1 (FETa2) off. When it becomes dark, the transistor FETa1 (FETa2) is turned on. On the contrary, the second switch Sb1 becomes ON when it is light and OFF when it is dark.

When it is dark, the first and second photosensors LEDa1, LEDa2, and LEDb1 do not achieve the photovoltaic effect, so that the first switches Sa1 and Sa2 become ON, and the second switch Sb1 becomes OFF, as shown in FIG. 2(A). Accordingly, the secondary battery B drives the LEDs LED1 and LED2 in parallel.

When it is light, the first and second photosensors LEDa1, LEDa2, and LEDb1 achieve the photovoltaic effect, so that the first switches Sa1 and Sa2 become OFF, and the second switch Sb1 becomes ON, as shown In FIG. 2(B). Accordingly, the LEDs LED1 and LED2 are connected in series to charge the secondary battery B by the photovoltaic effect of the LEDs LED1 and LED2.

In this way, the present invention employs the LEDs LED1 and LED2, which originally serve as lighting and displaying elements, as solar cells by utilizing their photoelectric conversion characteristics to generate electricity during the daytime when no lighting is required. The electricity is accumulated in the secondary battery B and is used as part of lighting energy during the nighttime. This arrangement helps reduce the size of the power source of the lighting apparatus.

The photosensors LEDa1, LEDa2, and LEDb1 made of LEDs provide stronger photovoltaic effect than silicon solar cells. These photosensors, therefore, easily generate voltages higher than the respective threshold voltages of the transistors FETa1, FETa2, and FETb1 serving as switches. Accordingly, the switches have simple structures.

Since the LEDs are relatively inexpensive, the cost of the lighting apparatus is low.

FIG. 5 shows a lighting apparatus with LEDs according to a second aspect of the present invention. The lighting apparatus has first and second switches Sa1, Sa2, and Sb1 each having an adjuster for adjusting a delay time between the ON and OFF states of a corresponding one of field effect transistors FETa1, FETa2, and FETb1.

FIG. 5 also shows a third aspect of the present invention. According to the third aspect, first and second photosensors LEDa1l, LEDa12. LEDa21, LEDa22, LEDb1, and LEDb2 each made of a LED are optically coupled with first and second parallel LED arrays Involving LEDs LED11, LED12, and so on and LED21 LED22, and so on.

Namely, the second and third aspects of the present invention optically couple the first and second photosensors with the first and second LED arrays, and provide each of the first and second switches with the adjuster for adjusting a delay time between the ON and OFF states of a corresponding one of the FETs. The adjuster may be a CR time constant circuit. The LED arrays are intermittently turned on and off according to time constants determined by the CR time constant circuits.

During the daytime when no lighting is required, the LED arrays serving as lighting and displaying elements are used as solar cells to generate electricity, which is accumulated in a secondary battery B. The accumulated energy is used as part of lighting electricity during the nighttime. During the nighttime, the adjusters are used to intermittently turn on and off the LED arrays. This arrangement reduces power consumption, eliminates or minimizes a power source, and reduces costs.

These and other objects, features and advantages of the present invention will be more apparent from the following detailed description of preferred embodiments in conjunction with the accompanying drawings.

DETAILED DESCRIPTION OF THE EMBODIMENTS

Figure 1:
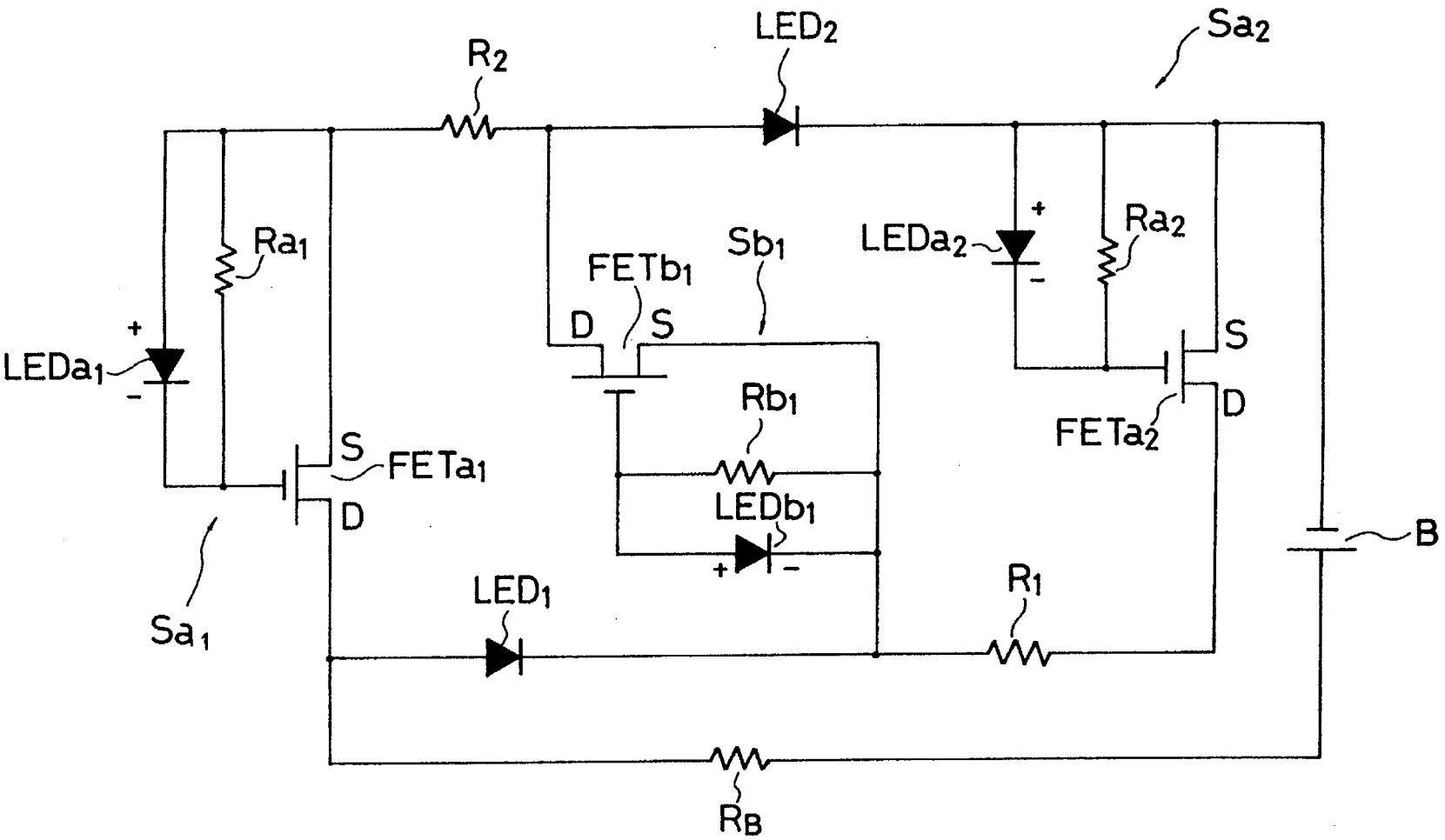
FIG. 1 is a circuit diagram showing a lighting apparatus with LEDs according to a first embodiment of the present invention.

FIG. 1 shows a circuit diagram showing a lighting apparatus with LEDs according to the first embodiment of the present invention.

The lighting apparatus has a secondary battery B, LEDs LED1 and LED2, first switches Sa1 and Sa2, and a second switch Sb1.

When the first switches Sa1 and Sa2 are each ON, i.e., closed and the second switch Sb1 is OFF, i.e., open, the LEDs LED1 and LED2 are connected in parallel with each other and in series with the secondary battery B.

When the first switches Sa1 and Sa2 are each OFF and the second switch Sb1 is ON, the LEDs LED1 and LED2 and secondary battery B are connected in series.

The LED LED1 is connected to a current limiting resistor R1 in series, and the LED LED2 is connected to a current limiting resistor R2 in series. The secondary battery B is connected to a charging current limiting resistor RB in series.

This embodiment employs the two first switches Sa1 and Sa2. The first switch Sa1 (Sa2) has a normally ON field effect transistor FETa1 (FETa2), a photosensor LEDa1 (LEDa2) made of a LED connected to the gate and source of the transistor FETa1 (FETa2), and a resistor Ra1 (Ra2).

When it is light, the photosensor LEDa1 (LEDa2) achieves the photovoltaic effect to apply a reverse bias voltage to the gate and source of the transistor FETa1 (FETa2), to turn the transistor FETa1 (FETa2) off.

When it is dark, the photosensor LEDa1 (LEDa2) achieves no photovoltaic effect, so that a forward bias voltage is applied to the gate and source of the transistor FETa1 (FETa2), to turn on the transistor FETa1 (FETa2) in the zero bias operation.

The second switch Sb1 has a normally OFF field effect transistor FETb1, a photosensor LEDb1 made of a LED connected to the gate and source of the transistor FETb1, and a resistor Rb1. The transistor FETb1 becomes ON by the photovoltaic effect of the LEDb1 when it is light and OFF in the zero bias operation by no photovoltaic effect of the LEDb1 when it is dark.

Figure 2A:
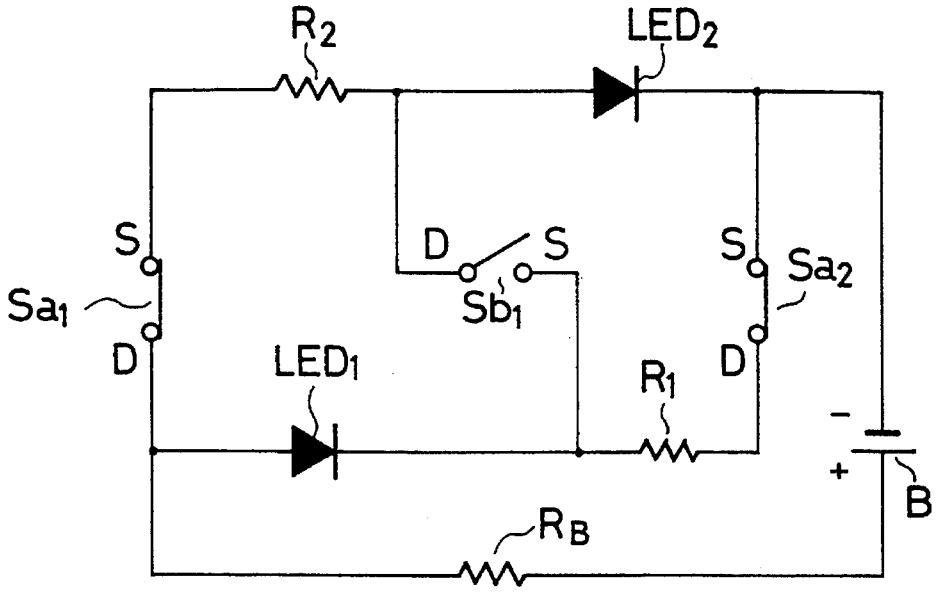
FIG. 2(A) shows a nighttime lighting operation of the first embodiment.
Figure 2B:
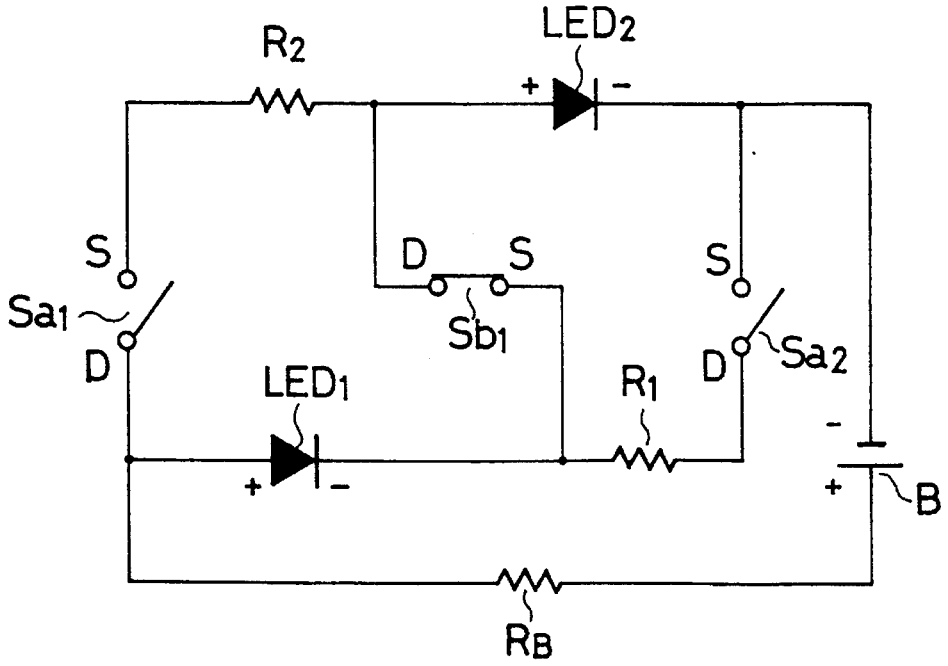
FIG. 2(B) shows a daytime charging operation of the first embodiment.

FIG. 2(A) shows a nighttime lighting operation of the circuit of FIG. 1, and FIG. 2(B) shows a daytime charging operation of the circuit of FIG. 1. For the sake of better understanding, the first and second switches Sa1, Sa2, and Sb1 are simplified in FIGS. 2(A) and 2(B).

When it is dark, the photosensors LEDa1, LEDa2, and LEDb1 achieve no photovoltaic effect, so that the first switches Sa1 and Sa2 become ON and the second switch Sb1 OFF, as shown in FIG. 2(A). Accordingly, the secondary battery B drives, through the resistor RB, a series circuit of the LED LED1 and resistor R1 and another series circuit of the LED LED2 and resistor R2 in parallel.

When it is light, the photosensors LEDa1, LEDa2, and LEDb1 achieve the photovoltaic effect, so that the first switches Sa1 and Sa2 become OFF and the second switch Sb1 ON, as shown in FIG. 2(B). Accordingly, the secondary battery B, resistor RB, and LEDs LED1 and LED2 are connected in series, to charge the secondary battery B.

When the LEDs LED1 and LED2 are lit during the nighttime, the resistors R1 and R2 serve as current limiting resistors. When the secondary battery B is charged during the daytime, the resistors R1 and R2 are disconnected from the circuit, to cause no power loss. The resistor RB serves as a current limiting resistor when charging the secondary battery B. These resistors may be omitted by substituting them by ON resistors of the FETs and by internal resistors that are active while the LEDs are generating power.

When the threshold voltages of the transistors FETa1, FETa2, and FETb1 are greater than the electromotive voltages of the corresponding photosensors LEDa1, LEDa2, and LEDb1, each two or more of the photosensors LEDa1, LEDa2, and LEDb1 may be connected in series.

Each of the LEDs LED1 and LED2 may be an array of LEDs connected in parallel with one another. The numbers of the LEDs in the arrays are determined according to a required lighting area and intensity. When charging the secondary battery B, the LED arrays are connected in series. Namely, LEDs are optionally selected and arranged according to a required charge voltage for the secondary battery B.

An experiment has been carried out with series connected two Ni—Cd batteries each having a terminal voltage of about 1.5 V serving as the secondary battery B and with high intensity red LEDs each made of GaAlAs of 660 nm in wavelength serving as the LEDs LED1 and LED2. In the experiment, each of the LEDs has provided a relatively large electromotive voltage of about 1.6 V under a room lamp of several hundreds luxes.

Figure 3:
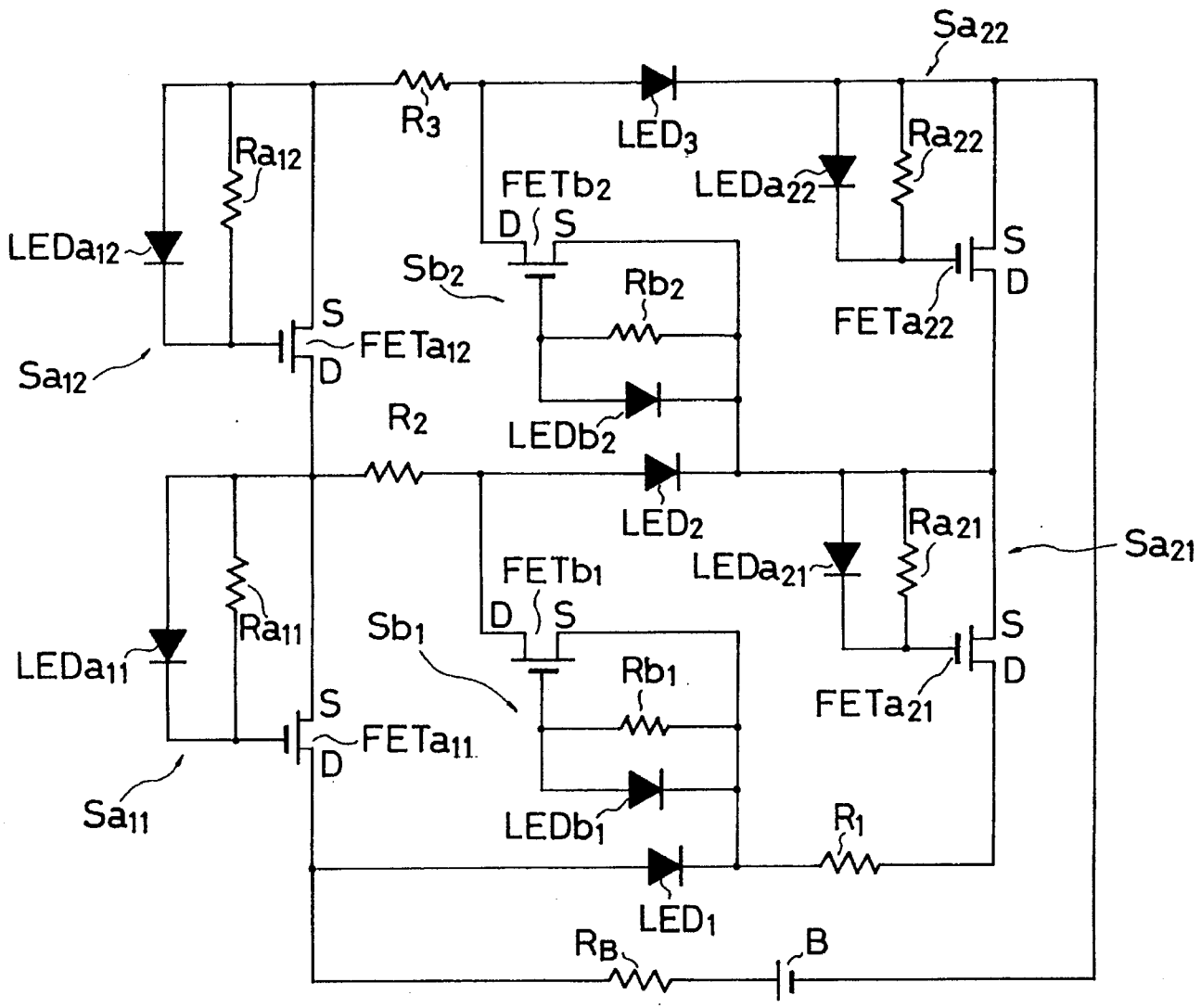
FIG. 3 is a circuit diagram showing a lighting apparatus with LEDs according to a second embodiment of the present invention.

FIG. 3 is a circuit diagram showing a lighting apparatus with LEDs according to a second embodiment of the present invention.

The lighting apparatus has a secondary battery B, LEDs LED1, LED2, and LED3, first switches Sa11, Sa12, Sa21, and Sa22, and second switches Sb1 and Sb2.

When the first switches are each ON, i.e., closed and second switches are each OFF, i.e., open, the LEDs are connected in parallel with one another and in series with the secondary battery B.

When the first switches are each OFF and the second switches are each ON, the LEDs and secondary battery B are connected in series.

The second embodiment provides higher charging capacity than the first embodiment because the three LEDs are connected in series when charging the secondary battery B. The first and second switches of the second embodiment are identical to those of the first embodiment.

Figure 4A:
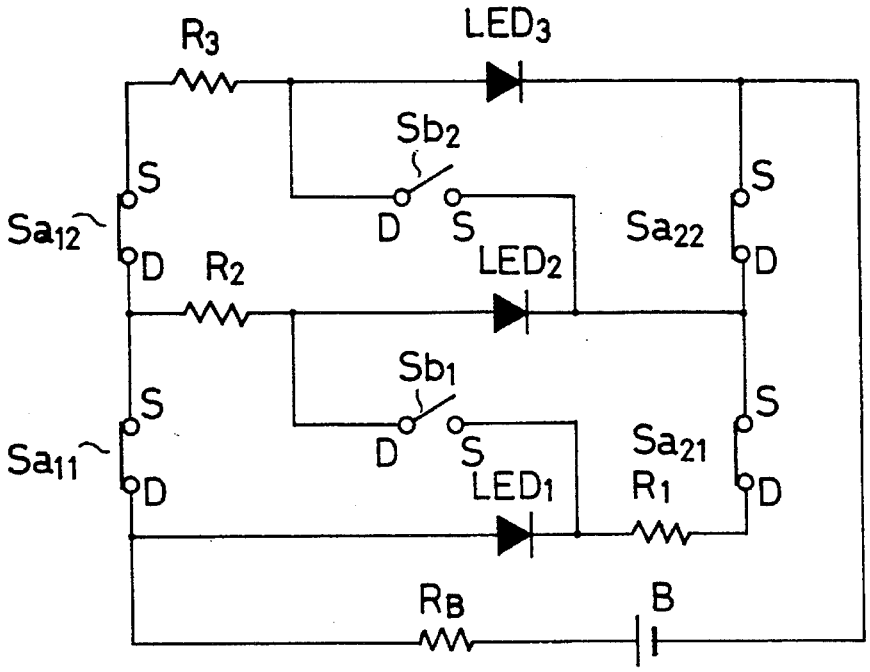
FIG. 4(A) shows a nighttime lighting operation of the second embodiment.
Figure 4B:
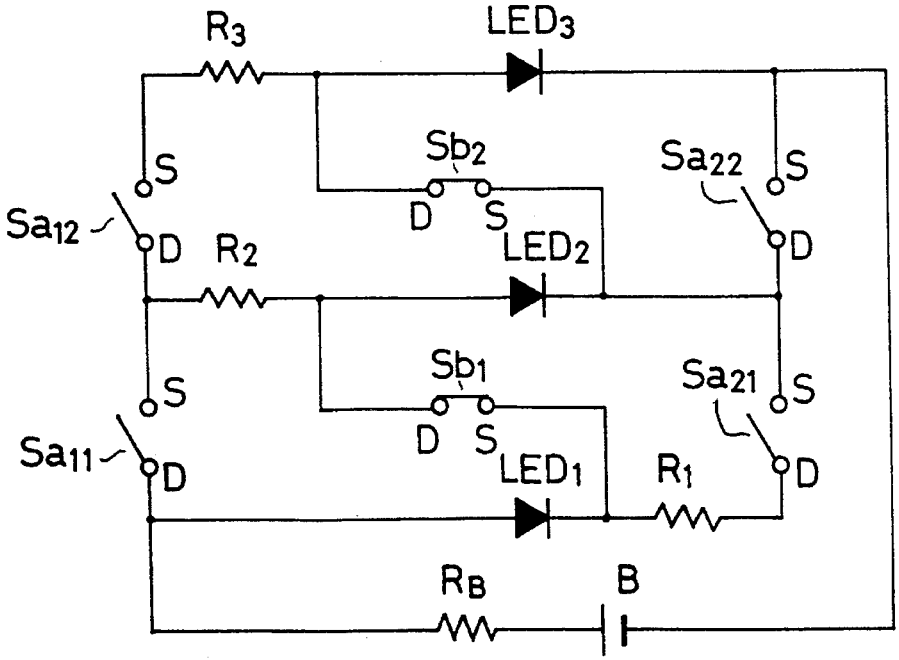
FIG. 4(B) shows a daytime charging operation of the second embodiment.

FIG. 4(A) shows a nighttime lighting operation of the lighting apparatus according to the second embodiment, and FIG. 4(B) shows a daytime charging operation of the same. For the sake of better understanding, the first and second switches are simplified in FIGS. 4(A) and 4(B).

When it is dark, the first switches are each ON and the second switches are each OFF as shown in FIG. 4(A). Accordingly, the secondary battery B drives, through a resistor RB, a series circuit of the LED LED1 and a resistor R1, another series circuit of the LED LED2 and a resistor R2, and the other series circuit of the LED LED3 and a resistor R3 in parallel.

When it is light, the first switches are each OFF and the second switches are each ON as shown in FIG. 4(B). Accordingly, the LEDs LED1, LED2, and LED3 are connected in series, and the total electromotive force of the three LEDs charges the secondary battery B through the resistor RB.

Figure 5:
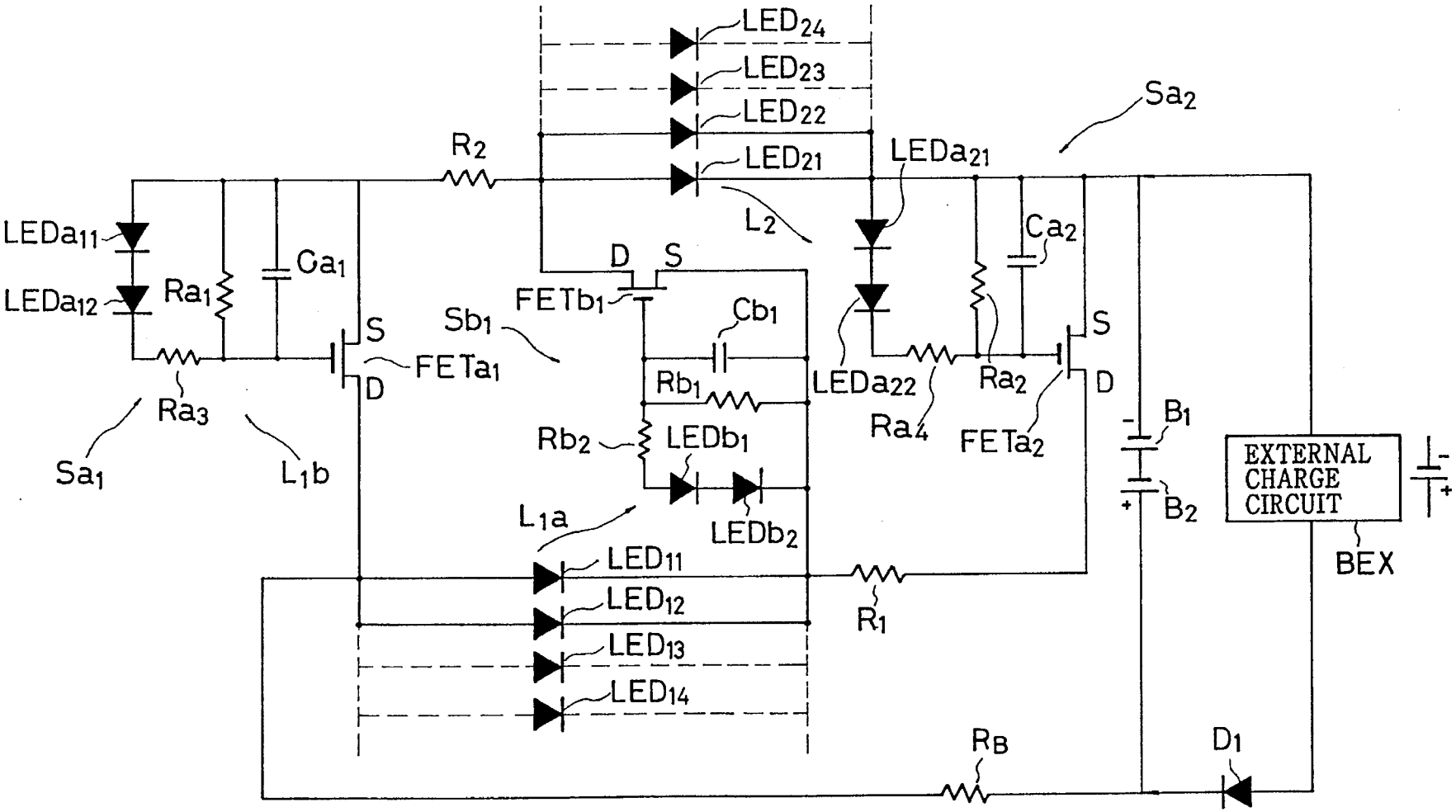
FIG. 5 is a circuit diagram showing a lighting apparatus with LEDs according to a third embodiment of the present invention.

FIG. 5 is a circuit diagram showing a lighting apparatus with LEDs according to a third embodiment of the present invention.

The lighting apparatus has secondary batteries B1 and B2, a first array of LEDs LED11, LED12, and so on connected in parallel with one another, a second array of LEDs LED21, LED22, and so on connected in parallel with one another, first switches Sa1 and Sa2, and a second switch Sb1.

When the first switches Sa1 and Sa2 are each ON, i.e., closed and the second switch Sb1 is OFF, i.e., open, the first and second LED arrays are connected in parallel with each other and in series with the secondary batteries B1 and B2.

When the first switches Sa1 and Sa2 are each OFF and the second switch Sb1 is ON, the first and second LED arrays and secondary batteries B1 and B2 are connected in series.

The first LED array is connected to a current limiting resistor R1 in series, and the second LED array is connected to a current limiting resistor R2 in series. The second batteries B1 and B2 are connected to a charging current limiting resistor RB in series. Each of the batteries B1 and B2 is made of, for example, NiCd and provides a voltage of about 1.6 V. The batteries B1 and B2 are connected in series to provide a sufficient voltage to light the first and second LED arrays. The batteries B1 and B2 are connected in parallel with a commercial power source or an external charge circuit BEX employing solar cells. A diode D1 is arranged to prevent a reverse current to the external charge circuit BEX.

The third embodiment arranges LEDs in parallel with one another to form the first and second LED arrays. This arrangement improves the photovoltaic performance of the LEDs serving as power generating elements and secures a required lighting area and intensity.

The third embodiment employs the two first switches Sa1 and Sa2. The switch Sa1 (Sa2) has a normally ON field effect transistor FETa1 (FETa2). The second switch Sb1 has a normally OFF field effect transistor FETb1.

A bias circuit is disposed between the gate and source of the transistor FETa1 (FETa2, FETb1). The bias circuit includes series connected two photosensors LEDa11 and LEDa12 (LEDa21 and LEDa22, LEDb1 and LEDb2) each made of a LED, a resistor Ra1 (Ra2, Rb1), and a capacitor Ca1 (Ca2, Cb1). These elements are connected in parallel with one another through a resistor Ra3 (Ra4, Rb2). In each of the bias circuits, the resistor and capacitor form a CR time constant circuit, which adjusts a delay time between the ON and OFF states of a corresponding one of the transistors FETa1, FETa2, and FETb1.

As indicated with reference marks L1*a* and L1*b*, the photosensors LEDa11, LEDa12, LEDb1, and LEDb2 of the switches Sa1 and Sb1 are optically coupled with the first LED array involving the LEDs LED11, LED12, and so on serving as charging-lighting-displaying elements. As indicated with a reference mark L2, the photosensors LEDa21 and LEDa22 of the switch Sa2 are optically coupled with the second LED array involving the LEDs LED21, LED22, and so on serving as charging-lighting-displaying elements.

The photosensors LEDa11, LEDa12, LEDa21, LEDa22, LEDb1, and LEDb2 receive light from the first and second LED arrays. When voltages produced by the photosensors exceed the threshold voltages of the corresponding transistors FETa1, FETa2, and FETb1, the transistors FETa1 and FETa2 are turned off and the transistor FETb1 is turned on, to thereby turn the first and second LED arrays off. This state corresponds to FIG. 2(B) with the LEDs of FIG. 2(B) being substituted by the LED arrays of FIG. 5.

Namely, the voltages produced by the photosensors are applied to the gates and sources of the corresponding transistors FETa1, FETa2, and FETb1 through the respective CR time constant circuits. As a result, the first and second LED arrays that are each ON are turned off with delays determined by the time constants of the CR time constant circuits.

Once the first and second LED arrays are turned off, charges at the gates of the transistors FETa1, FETa2, and FETb1 of the switches Sa1, Sa2, and Sb1 are discharged through the resistors Ra1, Ra2, and Rb1, respectively. When the gate potential drops below the threshold voltage of the FET in each of the switches Sa1, Sa2, and Sb1, the transistors FETa1 and FETa2 become each ON and the transistor FETb1 becomes OFF, to thereby again turn the first and second LED arrays on. This state corresponds to FIG. 2(A) with the LEDs of FIG. 2(A) being substituted by the LED arrays of FIG. 5.

The above operations are repeated to intermittently turn on and off the first and second LED arrays. The time constants of the CR time constant circuits in the bias circuits for the transistors FETa1, FETa2, and FETb1 may be properly set to select the ON and OFF periods of the LED arrays.

The third embodiment employs the external charge circuit BEX such as a silicon solar panel. The time constants of the CR time constant circuits may be properly selected to balance energy necessary for driving the first and second LED arrays with energy for charging the secondary batteries B1 and B2. Then, the intermittent lighting operation may be achieved without the external charging circuit BEX.

A proper number of the photosensors LEDa11, LEDa12, LEDa21, LEDa22, LEDb1, and LEDb2 each made of a LED may be connected in series in the respective switches Sa1, Sa2, and Sb1 according to the threshold voltages of the FETs serving as switching elements. Since the electromotive voltage of a LED is about 1.6 V that is larger than an electromotive voltage of about 0.5 V of a silicon solar cell, a small number of the photosensor LEDs will be sufficient for switching the FETs.

In summary, when it is dark, the first and second photosensors each made of a LED do not achieve the photovoltaic effect, and therefore, the first switches are ON and the second switch is OFF. Accordingly, the secondary battery drives the LED arrays in parallel.

When it is light, the first and second photosensors achieve the photovoltaic effect, to turn the first switches off and the second switch on. As a result, the LED arrays are connected in series to charge the secondary battery. Namely, the LED arrays serving as lighting and displaying elements are used as solar cells due to their photoelectric conversion characteristics, to produce electricity during the daytime when no lighting is required. The electricity is accumulated in the secondary battery. The accumulated electricity is used as part of lighting power during the nighttime. This helps reduce the size of the power source of the lighting apparatus.

LEDs achieve stronger photovoltaic effect than silicon solar cells, and therefore, the LEDs easily provide a voltage higher than the threshold voltage of a field effect transistor serving as a switch. The LEDs, therefore, help form simpler switches. The LEDs are relatively inexpensive and always available, to reduce the cost of lighting apparatuses.

The present invention optically couples the first and second photosensors each made of a LED with the parallel LED arrays, and provides each of the switches with an adjuster such as a CR time constant circuit for adjusting a delay time between the ON and OFF states of the FET. The adjusters are used to intermittently turn on and off the LED arrays during the nighttime according to time constants determined by the CR time constant circuits. During the daytime when no lighting is required, the LED arrays are used as solar cells to produce electricity, which is accumulated in the secondary battery. The accumulated electricity is used as part of lighting power during the nighttime. During the nighttime, the adjusters intermittently turn on the LED arrays. This technique shortens a lighting period during the nighttime, to thereby eliminate or minimize a commercial power source and reduce the cost of the lighting apparatus.

Various modifications will become possible for those skilled in the art after receiving the teachings of the present disclosure without departing from the scope thereof.

What is claimed is:

1. A lighting apparatus comprising:

a battery;

at least two light emitting means connected in parallel with each other for emitting light and charging the battery;

a plurality of first switching means in an ON state in the absence of ambient light and in an OFF state in the presence of ambient light; and a plurality of second switching means in an OFF state in the absence of ambient light and in an ON state in the presence of ambient light, said light emitting means being connected in parallel with each other and in series with said battery when said first switching means are each in an ON state and said second switching means are each in an OFF state causing light emitting means to emit light, and said light emitting means and said battery connected in series when said first switching means are each in the OFF state and said second switching means are each in the ON state causing the battery to charge.

2. The lighting apparatus according to claim 1, wherein each of said light emitting means is a LED array.

3. The lighting apparatus according to claim 2, wherein each of said first switching means has a first normally ON field effect transistor and a first photosensor made of a LED connected to the gate and source of the first transistor.

4. The lighting apparatus according to claim 3, wherein each of said second switching means has a second normally OFF field effect transistor and a second photosensor made of a LED connected to the gate and source of the second transistor.

5. The lighting apparatus according to claim 4, wherein, when it is light, the first photosensor of each of said first switching means achieves photovoltaic effect to apply a reverse bias voltage to the gate and source of the corresponding first transistor, to turn of the first transistor off, and when it is dark, the first transistor is turned on, and wherein said second switching means become ON when it is light and OFF when it is dark.

6. The lighting apparatus according to claim 4, wherein each of said first and second switching means has adjusting means for adjusting a delay time between the ON and OFF states of the field effect transistor.

7. The lighting apparatus according to claim 6, wherein the first and second photosensors are optically coupled with the corresponding LED arrays connected in parallel with each other.

* * * * *